US005383428A

United States Patent [19]

Fasola et al.

[11] Patent Number: 5,383,428

[45] Date of Patent: Jan. 24, 1995

[54] STARTER SYSTEM FOR AN INTERNAL COMBUSTION ENGINE AND A SOLENOID USABLE IN THE STARTER SYSTEM

[75] Inventors: Giancarlo Fasola, Milan; Mario Bassi, Cassina de' Pecchi, both of Italy

[73] Assignee: Industrie Magneti Marelli S.p.A., Milan, Italy

[21] Appl. No.: 34,275

[22] Filed: Mar. 22, 1993

[30] Foreign Application Priority Data

Mar. 24, 1992 [IT] Italy ..... TO92A000250

[51] Int. Cl.[6] ..... F02N 11/08

[52] U.S. Cl. ..... 123/179.3; 290/38 R; 324/145; 335/282; 361/152

[58] Field of Search ..... 123/179.25, 179.3, 179.1; 290/38 R; 361/170, 152; 307/10.6; 335/282; 324/145

[56] References Cited

U.S. PATENT DOCUMENTS 4,901,689 2/1990 Cummins et al. ..... 123/179.3

5,038,247 8/1991 Kelley et al. ..... 361/152

FOREIGN PATENT DOCUMENTS

0225444A1 6/1987 European Pat. Off. .

2611981 9/1988 France .

*Primary Examiner*—Andrew M. Dolinar

*Attorney, Agent, or Firm*—Edward D. Manzo

[57] ABSTRACT

The system includes a direct-current voltage supply, an electric motor for rotating a movable pinion, and an electromagnetic operating device including a solenoid and an associated movable core. The core moves the pinion towards an operating position in which it can be coupled for rotation with a rotary member of the internal combustion engine. The connection between the electromagnetic operating device and the voltage supply is controlled by an electronic unit which measures the current flowing in the solenoid by means of a portion of the wire forming the solenoid, which portion is bent and preferably twisted, and acts as a resistive shunt.

14 Claims, 2 Drawing Sheets

Figure 1:
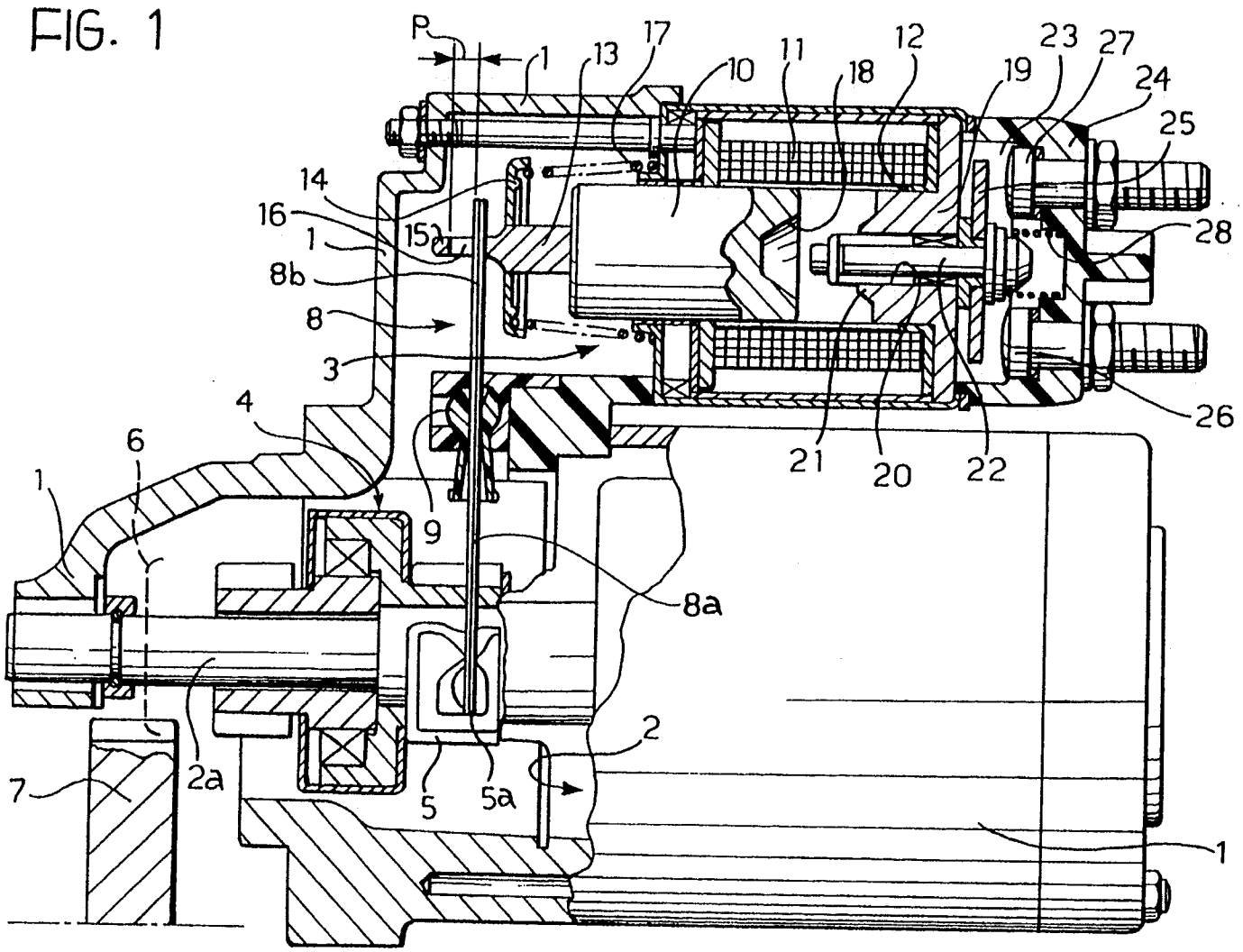

STARTER SYSTEM FOR AN INTERNAL COMBUSTION ENGINE AND A SOLENOID USABLE IN THE STARTER SYSTEM

The present invention relates to a starter system for internal combustion engine, particularly for motor vehicles.

More specifically, the invention relates to a starter system including:

a direct-current voltage supply, an electric starter motor for rotating a movable pinion, an electromagnetic operating device including a solenoid and an associated movable core which, as a result of the passage of a current through the solenoid, moves from a rest position to an operating position, giving rise to a corresponding movement of the pinion towards an operating position in which it can be coupled for rotation with a rotary member of the internal combustion engine, and to the supply of current to the electric starter motor, and control means for controlling the connection of the electromagnetic operating device to the voltage supply and the passage of current through the solenoid, the control means including an electronic device with controlled conduction, connected in series with the solenoid, and a control unit for driving the controlled-conduction device in a predetermined manner.

The starter system according to the invention is characterised in that it also includes sensor means for measuring the current flowing through the solenoid, and in that the control unit is connected to the sensor means and is arranged to drive the controlled-conduction device in such a manner that the current flowing in the solenoid varies according to a predetermined time law, to which a predetermined law of variation of the speeds of movement of the movable core and of the pinion correspond.

In the system according to the invention, the control of the current flowing through the solenoid ensures that the final speed at which the movable core reaches its operating position and strikes an associated stop, and the final speed at which the pinion is coupled with the associated rotary member of the internal combustion engine, are particularly low. This reduces the operating noise of the starter system considerably.

The invention also relates to a solenoid usable, in particular, in an electromagnetic operating device forming part of a starter system of the type described above and, more specifically, to a solenoid consisting in known manner of an electrical wire wound substantially in a helix.

The solenoid according to the invention is characterised in that a portion of the wire is bent so as to be substantially U-shaped, and is disposed in such a manner that, in operation, the magnetic flux linkage with this portion is low, or even essentially zero; the ends of this portion of the solenoid are accessible from the outside to enable the measurement, in use, of the voltage drop in this portion, which is indicative of the intensity of the current flowing in the solenoid.

This portion of the wire forming the solenoid acts as a resistive shunt and, to advantage, is an end portion of the wire, which is preferably twisted and disposed outside the solenoid, and oriented substantially parallel to the axis of the solenoid.

Figure 2:
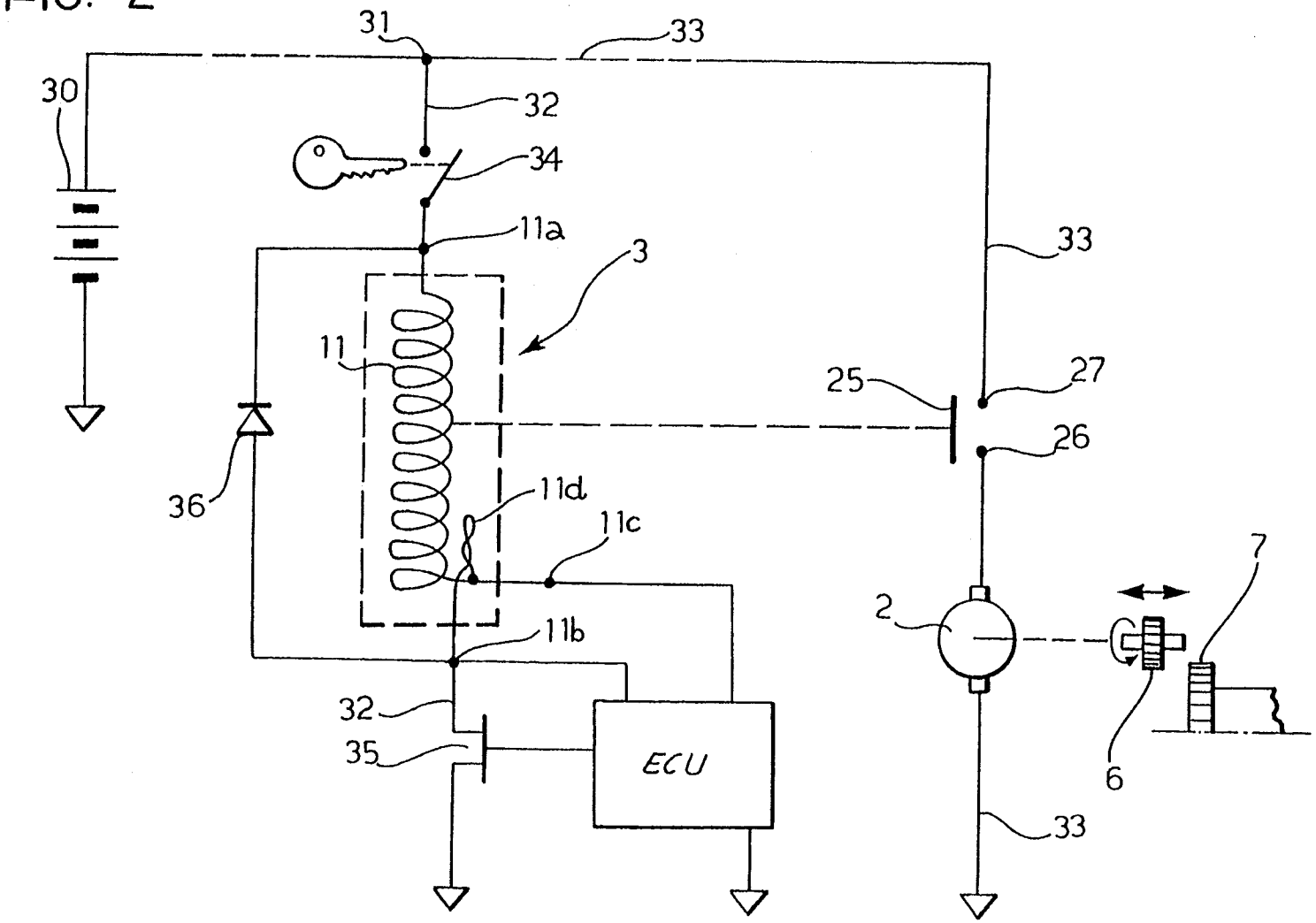

Further characteristics and advantages of the invention will become apparent from the following detailed description, with reference to the appended drawings provided purely by way of non-limiting example, in which:

FIG. 1 is a partially sectioned side view of a starter unit of known type, included in a starter system according to the invention; and FIG. 2 is circuit diagram, partially in block form, of a system according to the invention.

A starter system, for an internal combustion engine for motor vehicles, according to the invention includes a starter unit of the type shown in FIG. 1. The unit includes a support casing 1 in which an electric starter motor 2 and an electromagnetic operating device 3 are mounted. In the embodiment shown as an example, an overrunning (free wheel) coupling 4 is fitted to the shaft of the electric motor 2.

A sleeve 5 is movable on the shaft of the motor 2, together with the coupling 4.

A pinion 6, which is movable axially along an end portion 2*a* of the shaft of the electric motor 2, is connected to the side of the coupling 4 which faces away from the motor 2. In particular, the pinion 6 can move between a retracted, rest position, shown in continuous outline, and an advanced, operating position, shown in broken outline. In the latter position the pinion 6 can mesh with the teeth of a flywheel 7 of the internal combustion engine (not shown).

A rocker lever, indicated 8, can pivot about a fulcrum 9 and acts as a transmission member between the sleeve 5 (which acts as a member for moving the pinion 6) and a movable core 10 of the electromagnet 3.

The electromagnet has an operating winding or solenoid 11, supported by a spool 12, inside which the core 10 is movable axially.

One end of the core has an axial extension 13, around which a small plate 14 is fixed. The end of the extension has an appendage 15 containing a slot 16, through which one end 8*b* of the rocker lever extends.

In the embodiment shown, the lever 8 is of the leaf spring type, and consists of two substantially Y-shaped metal plates joined together, and having lower ends 8*a* forming two prongs which engage in seats 5*a* in the sides of the sleeve 5.

A helical spring, indicated 17, reacts against the small plate 14, keeping the core 10 in the position shown, in which it projects partially from the operating winding or solenoid 11.

The far end of the core 10 from its extension 13 has a frustoconical recess 18.

A fixed core, generally indicated 19, is inserted in the end of the spool 12 of the electromagnet, which faces away from the side opposite the lever 8.

The fixed core has a passage 20 coaxial with the spool 12 and the core 10. One end of the passage opens in the centre of a frustoconical protuberance 21 of the fixed core, the protuberance 21 facing the recess 18 of the movable core 10, and being complementary in shape thereto.

A rod 22 having one end which extends into a region 23, defined between the fixed core 19 and an essentially cup-shaped insulating body 24, is movable axially in the passage 20. This end of the rod 22 bears a contact member (a mobile contact) 25 which can cooperate with a pair of fixed contacts 26 and 27, in the form of screws, supported by the end wall of the insulating element 24.

A spring 28 is interposed between the insulating body 24 and the end head of the rod 22 and—at rest—keeps the latter in the position shown, in which its other end extends towards the movable core 10, projecting beyond the protuberance 21 of the fixed core 19. In this condition the mobile contact 25 is separated from the fixed contacts 26 and 27.

This movable contact and the associated fixed contacts together constitute an electrical switch which controls the current supply to the electric motor 2 (in known manner). The switch closes when, as a result of the excitation of the operating solenoid 11, the movable core 10 moves towards the fixed core 19, giving rise (in the final stage of its travel) to the movement of the rod 22 and of the associated movable contact 25 towards the fixed contacts 26 and 27.

The movement of the movable core 10 as a result of the excitation of the solenoid 11 also gives rise, by means of the rocker lever 8, to a corresponding movement of the pinion 6 from its rest position to its operating position in which it can mesh with the flywheel 7.

With reference to FIG. 2, a starter system for the internal combustion engine of a motor vehicle includes a direct-current voltage supply 30, advantageously consisting of the vehicle battery.

In the embodiment illustrated the negative pole of the battery 30 is earthed and the positive pole is connected to a junction 31. Two circuit branches indicated as 32 and 33 branch out from this junction.

Interposed in the branch 32 is a manually-operated switch 34 incorporated, for example, in a conventional ignition and starting switch operable by means of a key.

The solenoid 11 of the electromagnetic operating device 3 is connected in the circuit branch 32, and has one terminal **11*a* connected to the switch 34, and another terminal indicated 11*b*. An electronic device 35 with controlled-conduction such as, for example, a MOS transistor, is connected between the terminal 11*b*** and earth. This device has an input or control terminal connected to an electronic control unit indicated ECU.

The fixed contacts 26 and 27 are disposed in the circuit branch 33 in the manner illustrated. The electric starter motor 2 is also disposed in this circuit branch, between the fixed contact 26 and earth.

The solenoid 11 consists (in known manner) of a wire wound substantially in a helix.

According to the invention, a portion of the wire, indicated **11*d* in FIG. 2**, is bent so as to be substantially U-shaped, preferably with twisted arms.

In the embodiment illustrated as an example, the portion **11*d* is an end portion of the wire which forms the solenoid 11**.

To advantage, this portion of the solenoid is disposed outside the solenoid, and is oriented essentially parallel to the axis of the solenoid.

The ends of the portion **11*d* of the solenoid 11 are accessible from the outside by means of the terminal 11*b* and a further terminal, indicated 11*c***.

The shape and arrangement of the portion **11*d* of the solenoid 11** are such that, in operation, the magnetic flux linkage with this portion is very low and virtually zero.

The terminals **11*b* and 11*c*** are connected to corresponding inputs of the control unit ECU.

A diode 36 is disposed between the terminals **11*a* and 11*b* to protect the transistor 35** against overvoltages.

In operation, the portion **11*d* of the solenoid 11 acts essentially as a resistive shunt and the voltage drop between the terminals 11*b* and 11*c*** is indicative of the intensity of the current flowing in the solenoid.

The control unit ECU is arranged to drive the controlled-conduction device 35 in such a manner that the current flowing in the solenoid 11 (measured by the unit by means of the portion **11*d* of the solenoid) varies according to a predetermined time law, to which a predetermined law of variation of the speeds of movement of the movable core 10 and the pinion 6** corresponds.

In particular, the unit ECU is arranged to drive the controlled-conduction device 35 in such a manner that the speeds of the movable core 10 and of the pinion 6 when they reach their respective operative positions are below a predetermined value, for example, of the order of 0.2 m/sec.

The kinetic energy with which the movable core 10 strikes the fixed core 19, and the kinetic energy with which the pinion 6 strikes and meshes with the flywheel 7 of the internal combustion engine, are thus reduced considerably. This gives rise to significant reduction in the operating noise.

The unit ECU may be formed with the use of conventional analogue circuits or possibly at least partly with digital circuits.

The unit actually controls the speed of movement of the core 10 and of the pinion 6 by controlling the current which flows in the solenoid 11, and is measured by means of the portion **11*d*** thereof.

The portion **11*d* of the solenoid, which is advantageously disposed inside the same casing 40 as the solenoid, undergoes the same variations in resistance with variations in the operating temperature as the solenoid itself. This prevents errors in the measurement of the current flowing in the solenoid, which could occur if the portion 11*d* which acts as a resistive shunt were subjected to temperature conditions different from those of the solenoid 11**.

Naturally, the principle of the invention remaining the same, the details of construction and forms of embodiment may vary widely with respect to those described and illustrated, without thereby departing from the scope of the present invention.

We claim:

1. A starter system for an internal combustion engine, particularly for motor vehicles, including:

a direct-current voltage supply;

an electric starter motor for rotating a movable pinion;

an electromagnetic operating device including a solenoid and an associated movable core which, as a result of the passage of a current through the solenoid, moves from a rest position to an operating position, giving rise to a corresponding movement of the pinion towards an operating position in which the pinion can be coupled for rotation with a rotary member of the internal combustion engine, and to the supply of current to the electric starter motor;

control means for controlling connection of the electromagnetic operating device to the voltage supply and the passage of the current through the solenoid, the control means including a controlled-conduction device connected in series with the solenoid, and a control unit for driving the controlled-conduction device in a predetermined manner; and sensor means for measuring the current flowing through the solenoid, wherein the current flowing through the solenoid is indicative of any variation of the speed of movement of the movable core and of the pinion;

the control unit being connected to the sensor means and arranged to drive the controlled-conduction device in such a manner that the current flowing through the solenoid causes the speed of said pinion to be below a predetermined value, when the pinion reaches its operating position.

2. A starter system according to claim 1, wherein said predetermined value is of the order of 0.2 m/sec.

3. A starter system according to claim 1, wherein said sensor means comprises resistive shunt means for defining a voltage signal indicative of the intensity of the current flowing through the solenoid.

4. A starter system according to claim 3, wherein said solenoid comprises an electrical wire wound substantially in a helix, where said resistive shunt means comprises a portion of said electrical wire, and wherein said portion of said wire is configurated in such a manner that, in operation, the magnetic flux linkage with said portion is essentially zero.

5. A starter system according to claim 3, wherein said electromagnetic operating device includes a support casing for enclosing said solenoid and wherein said resistive shunt means have an active portion lodged internally to said casing and comprises ends accessible externally to said casing to enable measuring of said voltage signal.

6. A starter system according to claim 1, wherein said motor is connectable with the voltage supply through an electrical switch having fixed contacts and a movable contact and wherein said movable contact is actuatable for closing said fixed contacts and supply said motor when said core reaches its operative position, further comprising connecting means for connecting said core with said pinion in such a manner that the operative position of said pinion is reached before the operative position of said core.

7. A starter system for an internal combustion engine, particularly for motor vehicles, including:

a direct-current voltage supply;

an electric starter motor for rotating a movable pinion;

an electromagnetic operating device including a solenoid and an associated movable core which, as a result of the passage of a current through the solenoid, moves from a rest position to an operating position, giving rise to a corresponding movement of the pinion towards an operating position in which the pinion can be coupled for rotation with a rotary member of the internal combustion engine, and to the supply of current to the electric starter motor;

control means for controlling connection of the electromagnetic operating device to the voltage supply and the passage of the current through the solenoid, the control means including a controlled-conduction device connected in series with the solenoid, and a control unit for driving the controlled-conduction device in a predetermined manner; and sensor means for measuring the current flowing through the solenoid, the control unit being connected to the sensor means and arranged to drive the controlled-conduction device in such a manner that the current flowing in the solenoid varies according to a predetermined time law, to which a predetermined law of variation of the speeds of movement of the movable core and of the pinion corresponds;

wherein the sensor means comprises a portion of the wire forming the solenoid, the portion being bent so as to be substantially U-shaped, and being disposed in such a manner that, in operation, the magnetic flux linkage with the portion is low or essentially zero, and wherein the ends of the portion of the solenoid are connected to the control unit in such a manner that, in operation, the portion of the solenoid acts essentially as a resistive shunt, and the voltage between the ends of the portion is indicative of the intensity of the current flowing through the solenoid.

8. A starter system according to claim 7, wherein the portion of the solenoid which acts as the resistive shunt is an end portion of the solenoid.

9. A starter system according to claim 7 wherein the portion of the solenoid which acts as the resistive shunt is twisted.

10. A starter system according to claim 7 wherein the portion of the solenoid which acts as the resistive shunt is disposed outside the solenoid and is oriented substantially parallel to the axis of the solenoid.

11. A solenoid, particularly for use in an electromagnetic operating device usable in a starter system for the internal combustion engines of motor vehicles, comprising an electrical wire wound substantially in a helix, wherein a portion of the wire is bent so as to be substantially U-shaped and is disposed in such a manner that, in operation, the magnetic flux linkage with the portion is low or essentially zero; the ends of the portion being accessible to enable the measurement, in use, of the voltage drop in the portion, which is indicative of the intensity of a current flowing in the solenoid.

12. A solenoid according to claim 11, wherein said portion is formed at one end of the solenoid.

13. A solenoid according to claim 11, wherein said portion of the wire is twisted.

14. A solenoid according to claim. 11, wherein said portion of the wire is disposed outside the solenoid and is oriented substantially parallel to the axis of the solenoid.

* * * * *